US005273059A

United States Patent [19]

Gross et al.

[11] Patent Number: 5,273,059

[45] Date of Patent: Dec. 28, 1993

[54] APPARATUS FOR REMOVING COATINGS FROM LARGE SURFACE AREAS AND FOR CLEANING SUCH AREAS

[75] Inventors: Ernst-Peter Gross, Bremerhaven; Rolf Haak, Ganderkesee, both of Fed. Rep. of Germany

[73] Assignee: MBB Foerd-und Hebesysteme

[21] Appl. No.: 830,075

[22] Filed: Jan. 31, 1992

[30] Foreign Application Priority Data

Jan. 31, 1991 [DE] Fed. Rep. of Germany ..... 4102797

[51] Int. Cl.[5] ..... B08B 3/02

[52] U.S. Cl. ..... 134/57 R; 118/315; 118/323; 118/668; 134/104.1; 134/123; 134/172; 134/179; 901/43

[58] Field of Search ..... 134/45, 57 R, 104.1, 134/123, 172, 179, 180, 181; 118/315, 323, 668, 712; 901/43

[56] References Cited

U.S. PATENT DOCUMENTS

| | | | |
|---|---|---|---|
| 2,900,950 | 8/1959 | Peeps | 118/323 X |
| 3,081,736 | 3/1963 | Brady, Jr. | 118/323 |
| 3,561,398 | 2/1971 | Rose et al. | 901/43 X |
| 3,612,075 | 10/1971 | Cook | 134/123 X |
| 3,885,066 | 5/1975 | Schwenninger | 118/315 X |

FOREIGN PATENT DOCUMENTS 3530100 3/1986 Fed. Rep. of Germany .

*Primary Examiner*—Philip R. Coe

[57] ABSTRACT

Lacquer coatings are stripped from a large surface, e.g. aircraft and vehicle body surfaces, and the surface is simultaneously cleaned by a spraying device that carries at least three spraying units, each with at least one, preferably two, spray heads arranged in a row. Two outer spraying units flank one central spraying unit. The spraying device is secured to a free end of an outrigger arm on a mobile carriage, by a wrist mechanism, by a rod linkage, and by a mounting member (20*a*) tiltable by the rod linkage. The central spraying unit is directly secured to the tiltable mounting member while the two outer spraying units are secured by lazy tongues operable to track the contour of the large surface. Distance measuring sensors are arranged to measure the distance between the spray heads and the surface contour to provide respective distance signals to a central processing and control unit which controls the position of the spray heads in response to the distance signals and in response to optimal spacing values stored in a memory of the CPU to assure a desired spacing between the wall and all spray heads.

14 Claims, 2 Drawing Sheets

APPARATUS FOR REMOVING COATINGS FROM LARGE SURFACE AREAS AND FOR CLEANING SUCH AREAS

FIELD OF THE INVENTION

The invention relates to a cleaning apparatus capable of removing coatings from large surface areas and for cleaning such surface areas, for example, on large structures such as aircraft bodies, buses, motor vehicles, and so forth.

BACKGROUND INFORMATION

A cleaning apparatus of this type includes a manipulator mounted on a carriage and carrying spray heads connected to a source of high pressure cleaning fluid. German Patent Publication (DE) 3,530,100 (Koehler) describes such an apparatus in which the spraying device is supported on a gantry-type carrier or on a robot capable of directing or aiming the spraying device onto the surface area to be cleaned. Rotating nozzles of the known spraying device are supplied with a high pressure liquid, especially water pressurized within the range of 400 to 700 bar, whereby the spraying device is able to achieve a high surface area coverage even if the spacing between the spray head and the surface area to be cleaned is within the range of up to 1.5 m. Cleaning operations performed at such pressures are suitable only for relatively thick-walled structural components, such as ships and the like. Components having relatively thin walls, such as commercial aircraft, buses, or passenger vehicles, could be damaged when it is necessary to remove lacquer coatings from the surface with a high pressurized liquid when the spacings between the nozzles and the surface cannot be properly controlled. Even if no damage should occur, an incomplete coating removal and cleaning may occur if surface area portions are not uniformly treated.

OBJECTS OF THE INVENTION

In view of the foregoing it is the aim of the invention to achieve the following objects singly or in combination:

to provide an apparatus of the type described above, in which the spraying device can be brought into positions relative to the surface to be cleaned in a precisely controlled manner to assure small, well defined spacings between the cleaning nozzles and the surface to assure a proper removal of lacquer layers without troubles and without damaging the surfaces or structural components while still being able to use a sufficiently pressurized high pressure liquid;

to make it possible to efficiently remove lacquer layers even from relatively thin walls;

to guide the cleaning heads even efficiently relative to curved surfaces to be cleaned and to maintain defined spacings relative to such curved surfaces; and to continuously measure the spacing between a spray head and the surface to be treated, and to develop a control signal from such spacing for continuously controlling the spacing in closed loop fashion.

SUMMARY OF THE INVENTION

An apparatus according to the invention is characterized by the following features. A spraying device comprises at least three spraying units arranged next to each other, each spraying unit carrying at least one, preferably two, spray heads. A central spraying unit is flanked on opposite sides by two outer spraying units mounted on articulated tilting mechanisms capable of moving relative to the surface to be cleaned. A distance sensor is arranged on each spraying unit, e.g., between the two spraying heads, for sensing the spacing or distance between the sensor heads and the surface to be treated, and for producing a respective distance signal. A central processing and control unit receives the distance signal and produces a control signal for controlling an automatic drive of the spraying units to maintain a required or desired spacing between the surface to be treated and the spray heads by continuously tracking the motion of the spraying device and of the individual spray heads to follow the contour of a surface to be treated.

An optimal spacing between the surface to be treated and the spray heads is maintained by the invention, thus making it possible to remove lacquer coatings even from surfaces of thin walls and from walls having a complicated curvature without problems. This operation is assured even in hard to access corners. The invention with its spacing control makes sure that the sensors and thus the nozzle heads or spray heads maintain a defined spacing even when curved and round surfaces must be treated.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
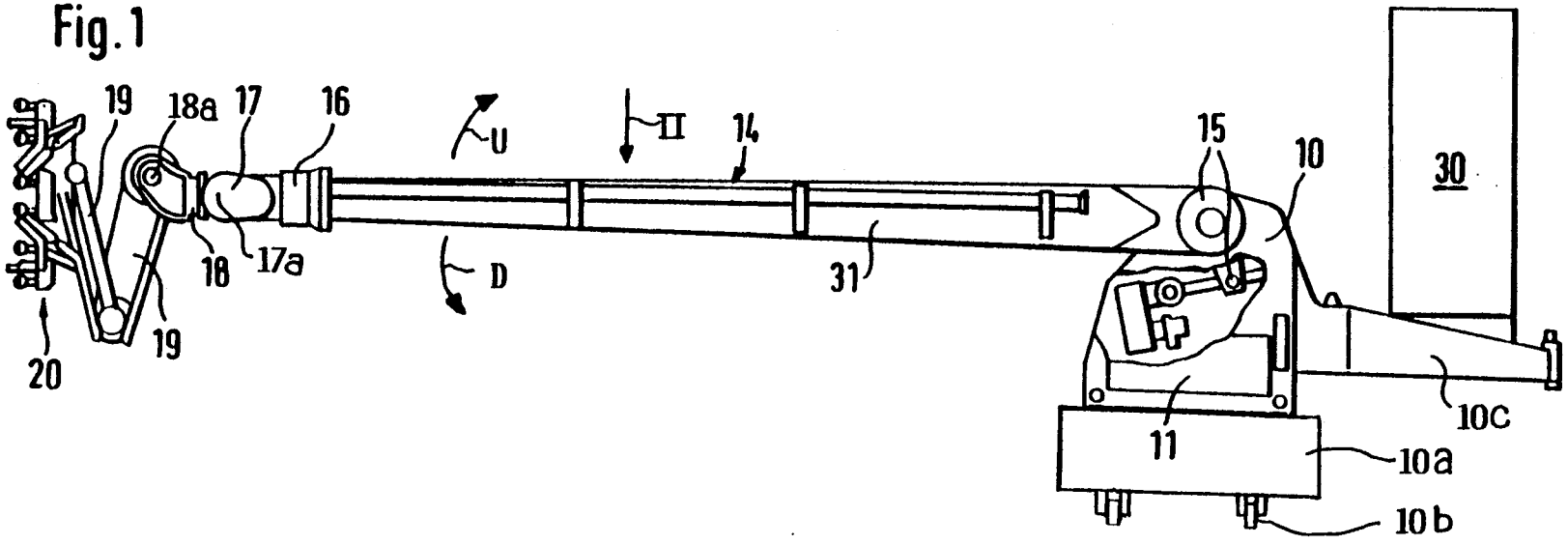
FIG. 1 shows a side view of the apparatus according to the invention illustrating a manipulator carrying an outrigger arm, the free end of which supports in an articulated manner a spraying device for the treatment of large surface areas.
Figure 2:
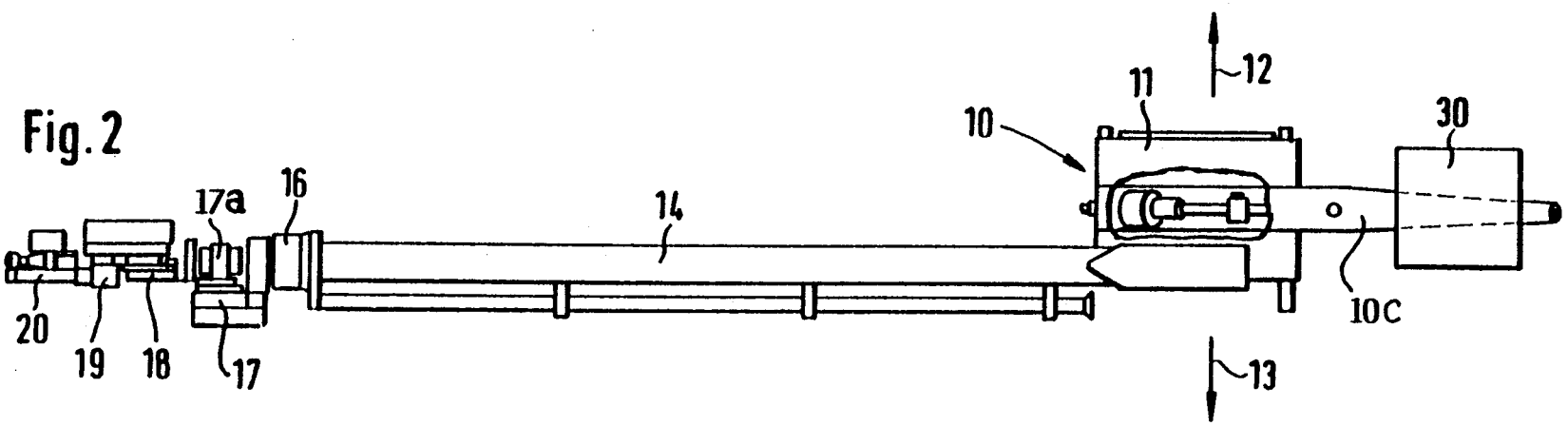
FIG. 2 is a view in the direction of the arrow II in FIG. 1.

Referring to FIGS. 1 and 2, a manipulator or robot mechanism 10 is mounted on a frame 11 which in turn is supported on a carriage 10*a* provided with wheels 10*b* for movement back and forth in the direction of the arrows 12 and 13 shown in FIG. 2. The wheels 10*b* may, for example, run on rails not shown. The frame 11 also supports an outrigger arm 14 of the manipulator 10 and support brackets 10*c* extending in a direction opposite to that of the outrigger arm 14. The brackets 10*c* support a control mechanism 30, as will be described in more detail below. The outrigger arm 14 may be of the telescoping type. A pitching gear drive 15 operates the outrigger arm 14 up and down as indicated by the arrows U and D. The extent of the angular up and down movement of the outrigger arm 14 depends on the pitching gear drive 15.

Figure 3:
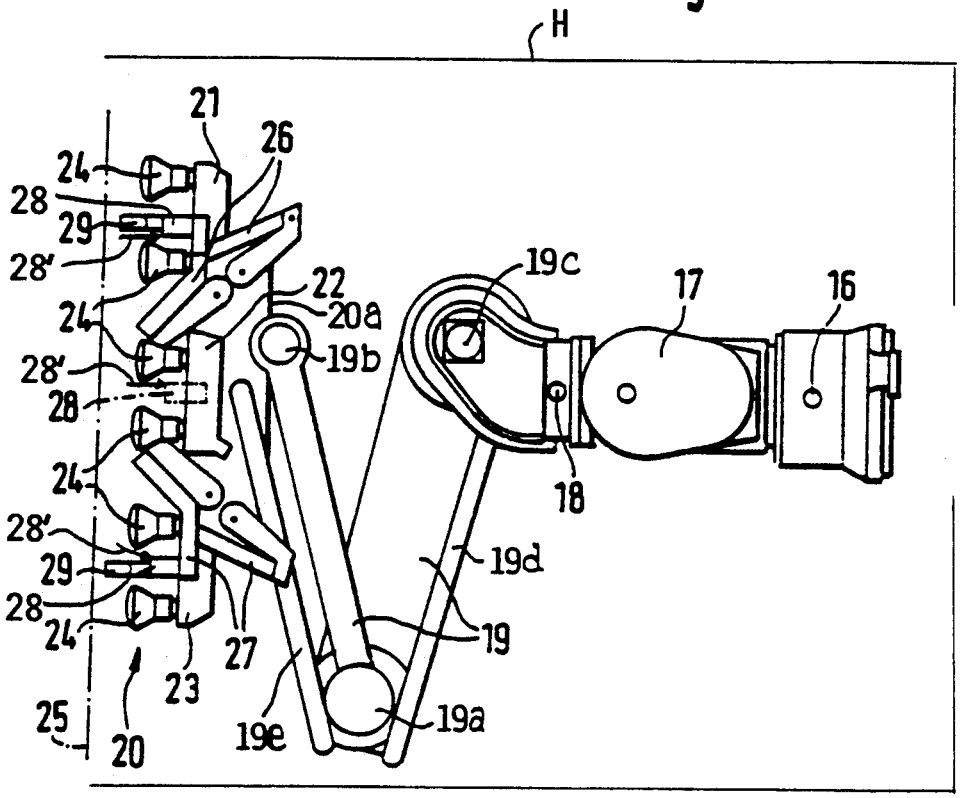
FIG. 3 shows a side view of the free end of the outrigger arm with the articulating linkage that secures the spraying device to the outrigger arm, whereby three spraying units are positioned in a row.
Figure 4:
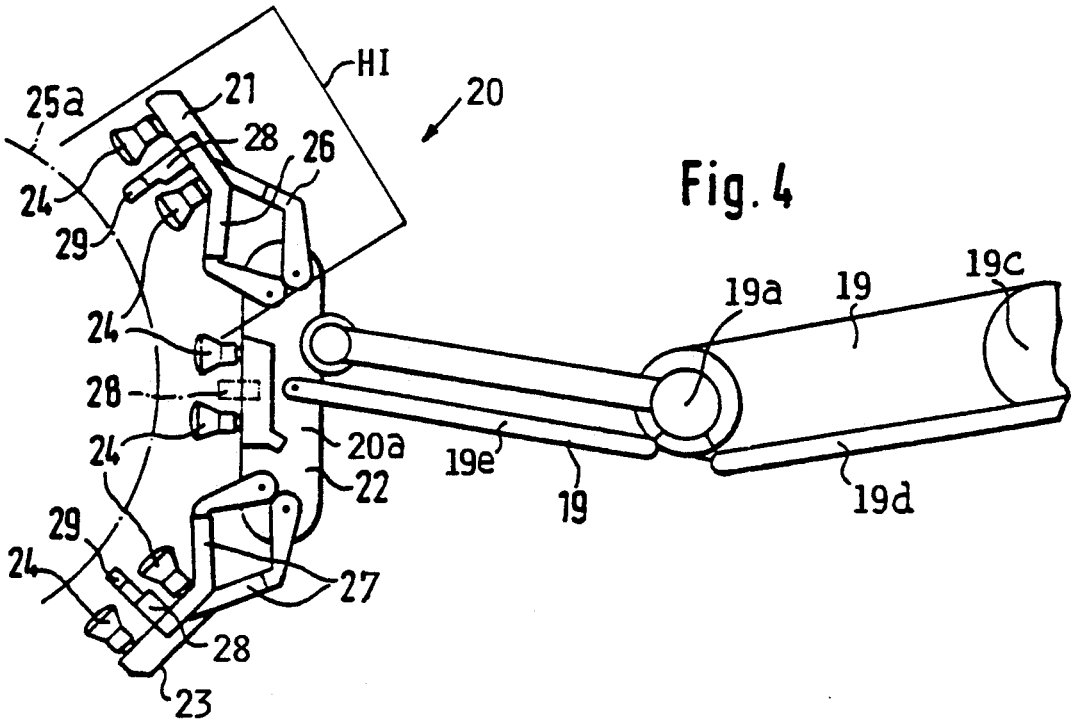
FIG. 4 is a view similar to that of FIG. 3, but showing the three spraying units extended or disposed around a curved surface.

Components 16, 17, and 18 constitute a wrist mechanism to which the spraying device 20 is secured by an articulated linkage mechanism 19. The wrist mechanism comprises a rolling gear drive 16 secured to the free end of the outrigger arm 14. The rolling gear drive 16 permits rotation about the longitudinal axis of the outrigger arm 14. A pitching gear drive 17 enables the spraying device 20 to perform a pitching movement about the pitching axis 17*a*. A tilting gear drive 18 connected to the pitching gear drive 17 and carrying the articulating linkage rods 19 permits a tilting about the axis 18*a*. The linkage rods 19 are constructed in the form of an upper and lower arm interconnected by an elbow joint 19*a* shown in FIGS. 3 and 4. The arms 19 can be pulled in as shown in FIG. 3 and extended as shown in FIG. 4, for positioning the spraying device 20. A journal 19*c* connects the arm 19 to the wrist mechanism 16, 17, 18.

Referring to FIGS. 3 and 4, the spraying device 20 comprises three spraying units 21, 22, and 23, each carrying preferably two spray heads 24 arranged in a vertical row in FIG. 3. The spraying device 20 is articulated to the arm type linkage mechanism 19 for positioning the individual spraying units 21, 22, and 23, and for displacing, or rather positioning, the spraying device 20 relative to the surface 25 to be treated. In FIG. 3, the surface 25 is a plane surface. However, in FIG. 4 the surface 25*a* is a curved surface. As best seen in FIG. 4, the outer spraying units 21 and 23 are articulated to a support or mounting member 20*a* while the inner spraying unit 22 is directly attached to the support or mounting member 20*a* without articulation, since the member 20*a* itself can journal about the axis of pivot or journal 19*b*. More specifically, a type of lazy tongue 26 carries the spraying unit 21. Another lazy tongue 27 supports the spraying unit 23. The drive mechanisms for positioning the spraying units 21 and 22 include drive rods 19*d* and 19*e* shown in FIGS. 3 and 4. The drives for extending and retracting the lazy tongues 26, 27 are not shown in FIG. 4 for simplicity's sake. Such drives per se are known in the art. These drives are able to position the three spraying units 21, 22, 23 relative to a curved surface 25*a* or relative to a plane surface 25.

A distance measuring sensor, such as a laser sensor 28 is positioned between the spray heads 24 on the spraying unit 22. Similar distance measuring sensors 28 are positioned between the respective spray heads 24 on the spraying units 21 and 23. These sensor units 28 measure the distance from the spray head to the wall 25, 25*a* and generate a corresponding distance signal that is supplied to the signal processing and control unit 30 which produces a control signal for the drive means of the positioning components for maintaining the desired spacing between the spray heads 24 and the surface of the wall 25, 25*a*. The distance sensors 28 are kept clean by an air jet merely indicated by an arrow 28' in FIG. 3. By keeping the distance measuring sensors 28 clean, an accurate, trouble-free distance measuring is assured.

The spray heads 24 may be of the type as disclosed in the above mentioned German Patent Publication 3,530,100 (Koehler). These spray heads may be equipped with nozzles arranged at an angle to assure an automatic rotation of the spraying portion of the spray head. The rotation is caused by the high pressure liquid passing through the spraying head, so that any external drive for the rotation of the spray head is not necessary.

It is preferable to enclose the spray head on the side toward the outrigger arm 14 with a hood H schematically shown in FIG. 3 or to enclose each spraying unit with an individual hood HI as shown schematically in FIG. 4. Only one hood HI is shown. These hoods collect the spraying liquid fog generated during an operation. Collecting devices for the cleaning fluid fog may be employed. However, such devices are not shown. These devices would be connected to the hood or hoods.

FIGS. 3 and 4 also show sensor rollers 29 carried by the outer spraying units 21 and 23 to generate a signal if these spraying units 21 and 23 should contact the surface 25,25*a*. Such a signal is also transmitted to the central processing and control unit 30 to generate a control signal for the withdrawal of the respective spraying unit away from the surface to be cleaned, or at least a signal is produced for stopping the further feed advance of the respective spraying unit toward the wall to be cleaned and to shut-off the liquid supply to the respective spraying heads 24.

By continuously sensing the spacing of the spraying units from the surface to be cleaned, and by storing the sensed values in a memory of the central processing unit 30, and by continuously updating the measured signals, it is assured that the optimal spacing between the spray heads and the wall to be cleaned is maintained throughout the stripping and cleaning operation.

In operation the spraying device 20 is continuously positioned relative to the wall to be cleaned by the several possible motions described above. Additionally, the travel of the carriage 10*a* in the direction of the arrows 12 and 13 along the wall to be cleaned, makes sure that an optimal position between wall and the spraying device 20 is maintained at all times, even if the wall is curved or crooked. It has been found that an adjustment range for the desired spacings within about 1 m is satisfactory and the respective articulating and rotating drives are dimensioned accordingly. Larger spacings can be compensated for by a displacement of the entire manipulating unit 10.

The present apparatus is suitable for removing lacquer layers from relatively thin-walled structures, such as aircraft bodies and the like, without any damage. The high pressure conduit 31 supplies the cleaning fluid or cleaning liquid to the spray heads 24 of the spraying device 20. A source of pressure and a cleaning fluid supply may be housed in the carriage 10*a*.

Although the invention has been described with reference to specific example embodiments, it will be appreciated that it is intended to cover all modifications and equivalents within the scope of the appended claims.

What we claim is:

1. An apparatus for removing a coating from and cleaning a large surface area, comprising a spraying device, manipulator means for carrying and positioning said spraying device into positions with a controllable spacing from said surface area, said spraying device comprising at least three spraying units (21, 22,23) arranged next to one another, each spraying unit comprising at least one rotating spray head receiving a cleaning fluid, said spraying units comprising a central spraying unit (22) between two outer spraying units, positioning means including tilting mechanisms carrying said spraying units and capable of following or tracking a surface contour, each spraying unit further comprising sensor means (28) arranged for sensing a spacing between said surface contour and said spray heads, said sensor means producing distance signals representing said spacing, and a central processing and control unit (30) receiving said distance signals for producing a control signal for controlling the positioning of said spraying units so that the spacing between said spray heads (24) and said surface area corresponds to a desired spacing.

2. The apparatus of claim 1, wherein said spray heads comprise nozzles arranged at an angle proper for producing an automatic rotation of said spray heads in response to pressurized fluid flowing through said spray heads.

3. The apparatus of claim 1, wherein said tilting mechanisms of said two outer spray units (21, 23) comprise a lever mechanism and drive means for operating said lever mechanism.

4. The apparatus of claim 1, wherein said positioning means comprise a wrist mechanism and a rod linkage (19) connecting said three spraying units of said spraying device to said wrist mechanism (16, 17, 18), said manipulator means comprising a manipulating outrigger or cantilever arm (14), said wrist mechanism being connected to a free end of said outrigger or cantilever arm (14), and wherein said rod linkage (19) permits a longitudinal adjustment relative to a longitudinal axis of said arm (14) while said wrist mechanism permits a rolling and pitching motion of the spraying device.

5. The apparatus of claim 1, wherein said sensor means (28) for controlling the spacing of said spray heads (24) from the surface contour comprise distance measuring lasers.

6. The apparatus of claim 1, wherein said sensor means (28) comprise an air nozzle for keeping the sensor face of said sensors free of contamination to assure a measurement of said spacing free of any faults.

7. The apparatus of claim 1, wherein said spraying units (21, 22, 23) comprise a protective hood for containing any spraying fog generated during an operation.

8. The apparatus of claim 1, further comprising sensor roller means for contacting said surface contour to provide a safety shut-off signal when said spacing becomes less than a fixed minimum as determined by the position of said sensor roller means, said shut-off signal stopping a closing-in motion of said spraying device and for also shutting off a liquid supply to said spray heads.

9. The apparatus of claim 1, further comprising a mobile carriage supporting said manipulator means (10), said positioning means of said manipulator means comprising an outrigger arm (14) for transporting or moving said apparatus alongside said surface area.

10. The apparatus of claim 9, wherein at least one of said mobile carriage and said outrigger arm (14) is displaceable substantially perpendicularly to said surface area for maintaining said desired spacing between said spraying device (20) and said surface area.

11. The apparatus of claim 9, wherein said sensor means (28) comprise a plurality of sensor members for continuously sensing the position of said spray heads relative to said surface area for further sensing the instantaneous position of said positioning means carrying said spraying device (20), and for also sensing the position of said mobile carriage, said sensor members supplying respective distance signals to a memory of said central processing and control unit (30) for maintaining an optimal spacing between said spraying device (20) and said surface area.

12. The apparatus of claim 1, wherein each of said spraying units comprises two neighboring spray heads arranged in a row, and wherein said sensor means comprise one sensor member between said two neighboring spray heads of each spraying unit.

13. The apparatus of claim 1, wherein said carrying and positioning means comprise cantilevered support means (10*c*) extending in a direction opposite to said positioning means, and wherein said central processing and control unit is mounted on said cantilevered support means for balance.

14. The apparatus of claim 1, wherein said positioning means for said spraying units comprise a mounting member (20*a*), said tilting means comprising a cantilevered arm, a wrist mechanism at a free end of said cantilevered arm, a rod linkage between said wrist mechanism and said mounting member (20*a*) for tilting said mounting member, said central spraying unit (22) being secured to said mounting member (20), and lazy tongue means (26, 27) connecting said two outer spraying units (21 and 23) to said mounting member (20*a*).

* * * * *

UNITED STATES PATENT AND TRADEMARK OFFICE

CERTIFICATE OF CORRECTION

PATENT NO. : 5,273,059

DATED : Dec. 28, 1993

INVENTOR(S) : Ernst-Peter Gross et al.

It is certified that error appears in the above-identified patent and that said Letters Patent is hereby corrected as shown below:

On the title page:

in [73] Assignee, replace "MBB Foerd- und Hebesysteme"

by --MBB Foerder- und Hebesysteme GmbH, Delmenhorst, Fed. Rep. of Germany--;

Under the line "Primary Examiner ...." insert --Attorney, Agent, or Firm - W. G. Fasse--;

In [57] Abstract, line 13, replace "the" (2nd occurrence) by --said--.

Signed and Sealed this

Nineteenth Day of July, 1994

Bruce Lehman

*Attest:*

BRUCE LEHMAN

*Attesting Officer*

*Commissioner of Patents and Trademarks*